US006378434B1

(12) United States Patent
Gasparrini et al.

(10) Patent No.: US 6,378,434 B1
(45) Date of Patent: Apr. 30, 2002

(54) ADJUSTABLE MATTE FOR HANDLING SHEETS IN A PRINTING PRESS AND METHOD OF USING SAME

(75) Inventors: Charles R. Gasparrini, Rye, NY (US); Edward E. Marganski, Ansonia; Richard P. Rubin, Fairfield, both of CT (US); Robert L. Ruch, Canton, GA (US)

(73) Assignee: Baldwin GraphicSystem, Inc., Shelton, CT (US)

( * ) Notice: Subject to any disclaimer, the term of this patent is extended or adjusted under 35 U.S.C. 154(b) by 0 days.

(21) Appl. No.: 09/520,851

(22) Filed: Mar. 7, 2000

(51) Int. Cl.[7] ..... B41L 15/10

(52) U.S. Cl. ..... 101/483; 101/232; 101/420; 492/4

(58) Field of Search ..... 101/483, 482, 101/419, 420, 421, 422, 407, 232, 415.1; 492/4, 5, 48; 441/40; 29/887

(56) References Cited

U.S. PATENT DOCUMENTS 4,327,467 A * 5/1982 Quaint ..... 492/4
4,402,267 A 9/1983 DeMoore
4,425,695 A * 1/1984 Tokuno ..... 492/4
4,509,642 A * 4/1985 Rowell et al. ..... 492/4
4,629,433 A * 12/1986 Magid ..... 441/40
4,694,750 A * 9/1987 Greene ..... 101/420
5,070,597 A * 12/1991 Holt et al. ..... 29/887
5,579,691 A * 12/1996 Voge ..... 101/420
5,634,606 A * 6/1997 Röder ..... 492/4
5,842,412 A * 12/1998 Greenway ..... 101/420
6,082,260 A * 7/2000 Friedrichs et al. ..... 101/232
6,129,017 A * 10/2000 Mohrmann et al. ..... 492/4

* cited by examiner

*Primary Examiner*—Eugene Eickholt
(74) *Attorney, Agent, or Firm*—Morgan & Finnegan, LLP

(57) ABSTRACT

An apparatus for facilitating handling of sheets in a sheet-fed printing press comprising a matte that is mountable on a cylinder. The matte has at least one inflatable pocket for cushioning sheets of printable material as they are passed between two cylinders of the press. At least one valve communicates with the inflatable pocket and controls the quantity of fluid in the inflatable pocket. A number of inflatable pockets can be utilized to provide increased control over various sheet sizes. Further control may be obtained by including a number of valves to independently operate each of the inflatable pockets. Ease of installation and removal is accomplished by incorporated mounting holes along the long axis of the matte. Alternatively, the matte may be arranged on the cylinder by adhesively bonding (tape or glue) the matte to the surface of the cylinder or by arranging the matte on the cylinder with Velcro fasteners. A number of mattes may be combined to form a compound matte resulting in greater resolution and precision. Methods for making as well as using the apparatus are also disclosed.

55 Claims, 12 Drawing Sheets

ADJUSTABLE MATTE FOR HANDLING SHEETS IN A PRINTING PRESS AND METHOD OF USING SAME

BACKGROUND OF THE INVENTION

1. The Field of the Invention

The present invention relates generally to a system and method of reducing marking or smearing of printed sheets on sheet-fed printing presses, and, more particularly, to a matte for use on a cylinder in a sheet-fed printing press.

2. Description of Related Art

Marking and smearing of freshly printed sheets during high speed printing operations on sheet-fed printers have historically been troublesome, costly and time consuming problems. Various methods have been employed to effectuate the handling and transfer of freshly printed sheets between printing stations, or between a printing station and a press delivery, without marking or smearing of the printed sheets. These methods have utilized various types of skeleton wheels, cylinders and other mechanical devices.

Skeleton wheels typically attempt to minimize contact with the printed sheet by using projections or serrations. However, some inherent problems associated with the use of skeleton wheels include sliding of the printed sheet over the projections or serrations or damaging of the sheet itself through indenting or dimpling. By contrast, other methods do not attempt to minimize contact with the printed sheet but instead either provide a coating material applied directly to a transfer cylinder or skeleton wheel which acts as an ink repellant or by mounting a covering on the transfer cylinder or skeleton wheel which is itself coated with an ink repellant and which additionally performs a cushioning function.

The drawbacks and shortcomings of these approaches have resulted in increased labor costs and the attendant loss of efficiency (attributed to: complex installations; increased setup time to accommodate varying sheet sizes, and increased time for frequent washing of the transfer cylinders), increased make-ready time, high maintenance requirements and increased waste. Some of these inherent drawbacks and shortcomings of these various methods are more fully discussed in U.S. Pat. Nos. 5,842,412 and 4,402,267.

In a sheet-fed press, the leading edge of a sheet of printable material is guided via a gripper whereas the trailing edge is typically free. During operation, the gripper pulls the leading edge of the sheet of printable material through the space found generally between two cylinders of the press. This space, or gap, between two adjacent cylinders of the press is often referred to as the "nip." High speed operation of a press using such a gripper arrangement results in additional drawbacks or shortcomings generally known by those of ordinary skill in the art of sheet-fed printing. Some of these additional drawbacks or shortcomings include, but are not necessarily limited to, smearing or marking of wet images, dot distortion, print length difference between one print station and another during transfer within a print output device and "slap-out" of the trailing edge of a printed sheet of material.

Slap-out occurs due to a combination of factors, including but not necessarily limited to the trailing edge of the sheet being free, the tendency of the printed sheet to return to a flat or straight position, and the path of the trailing edge through the nip being defined as something other than tangentially between the two cylinders; i.e., since the surface on which the sheet travels is cylindrical and since the opposing surface is also cylindrical, there exists a path between the two surfaces located at the nip which would be simultaneously tangential to both opposing cylindrical surfaces. Were the sheet to travel along this tangential path, there would be no associated problem of slap-out no matter how fast the press was operated. However, since the actual path of the printed sheet is never along this tangential path, the problem of slap-out becomes prevalent and increases with press speed and the degree to which the printed sheet must alter its course from the tangential path.

Therefore, a need exists for an improved device and method to reduce smearing or marking of wet images, dot distortion, print length difference between one print station and another during transfer within a print output device and "slap-out" of the trailing edge of a printed sheet of material.

SUMMARY OF THE INVENTION

In one embodiment, an apparatus for facilitating handling of sheets in a sheet-fed printing press includes a matte that is mountable on the transfer cylinder. The matte has at least one inflatable pocket for cushioning sheets of printable material as they are passed through the nip. At least one valve arranged to be in fluid communication with the inflatable pocket may be provided for controlling a quantity of fluid in the inflatable pocket. The cushioning provided by use of such an apparatus reduces smearing or marking of wet images, dot distortion, print length difference between one print station and another during transfer within a print output device and "slap-out" of the trailing edge of a printed sheet of material.

In another embodiment, a plurality of inflatable pockets located at locations spaced along the long axis of the matte may be included to provide for increased control over various sheet sizes. Additional control over various sheet sizes may be obtained by including a plurality of valves to independently operate each of the inflatable pockets. Ease of installation and removal is accomplished by incorporated mounting holes along the long axis of the matte. Alternatively, the matte may be arranged on the cylinder by adhesively bonding (tape or glue) the matte to the surface of the cylinder or by arranging the matte on the cylinder with VELCRO hook and loop fasteners.

In another embodiment of the present invention, the transfer cylinder is adapted to receive at least one inflatable tube directly onto the outer surface of the transfer cylinder. At least one valve arranged to be in fluid communication with the inflatable tube may be provided for controlling the quantity of fluid in the inflatable tubes.

A plurality of inflatable tubes may be arranged onto the outer surface of the transfer cylinder and at a plurality of locations along the transfer cylinder's length in order to provide increased control over various sheet sizes. Additional control over various sheet sizes may be obtained by including a plurality of valves for independently controlling the quantity of fluid in each of the plurality of inflatable tubes.

In yet another embodiment, a plurality of grooves are provided in the outer surface of the transfer cylinder extending along the circumference of the transfer cylinder. A pliable membrane is then arranged onto the transfer cylinder and is sealingly attached to the outer surface of the transfer cylinder so as to form sealed cavities. In order to reduce the sealing area, the pliable membrane may be sealingly attached at the outer periphery of each groove, or anywhere from the outer periphery of one groove to a point on the outer surface of the transfer cylinder that is halfway to the next adjacent groove. The pliable membrane may also be sealed to the entire exposed surface of the transfer cylinder as well. Sealing may be effectuated using either an adhesive (tape or glue) or a mechanical sealing means such as an O-ring.

At least one valve arranged to be in fluid communication with the sealed cavities may be provided for controlling the quantity of fluid in the sealed cavities. A plurality of grooves spaced at locations preferably along the long axis of the transfer cylinder resulting in a plurality of sealed cavities may be provided for increased control over various sheet sizes. Additional control over various sheet sizes may be obtained by including a plurality of valves for independently controlling the quantity of fluid in each of the plurality of sealed cavities.

In another embodiment of the invention, a compound matte including at least two mattes is mountable on a cylinder of a sheet-fed printing press. The compound matte includes a first matte and a second matte, each matte having at least one inflatable pocket for cushioning sheets of printed material as they are passed through the first and second cylinders. The second matte is arranged on the first matte and the second matte has openings adapted to allow the at least one inflatable pocket of the first matte to pass when it is inflated.

The invention also includes the method of fabricating a matte having at least one inflatable pocket for facilitating handling of sheets in a sheet-fed printing press. The method includes the steps of selecting an appropriate material and forming the matte with at least one inflatable pocket using means suitable for the chosen material.

Additionally, the invention also includes the method of facilitating handling of sheets in a sheet-fed printing press which includes arranging a matte with at least one inflatable pocket onto the transfer cylinder, selecting a printed sheet size to be fed through the press, actuating at least one valve for controlling the quantity of fluid in the inflatable pocket in accordance with the sheet size selected and operating the sheet-fed printing press so as to cause the printed sheet to be passed through the nip.

BRIEF DESCRIPTION OF DRAWINGS

The accompanying drawings illustrate certain embodiments of the invention.

DETAILED DESCRIPTION OF THE PREFERRED EMBODIMENTS

Figure 1B:
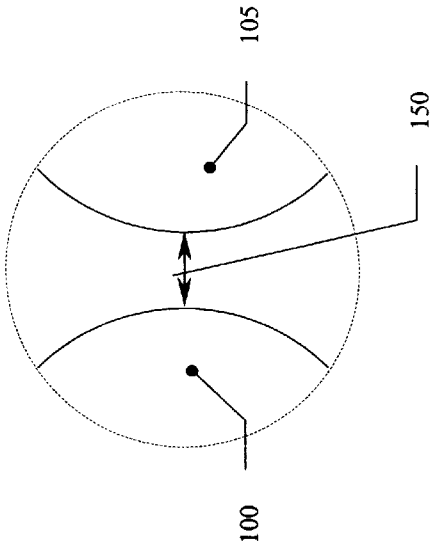
FIG. 1*b* is an enlarged view of a "nip," or gap, between the transfer cylinder and the impression cylinder.
Figure 1A:
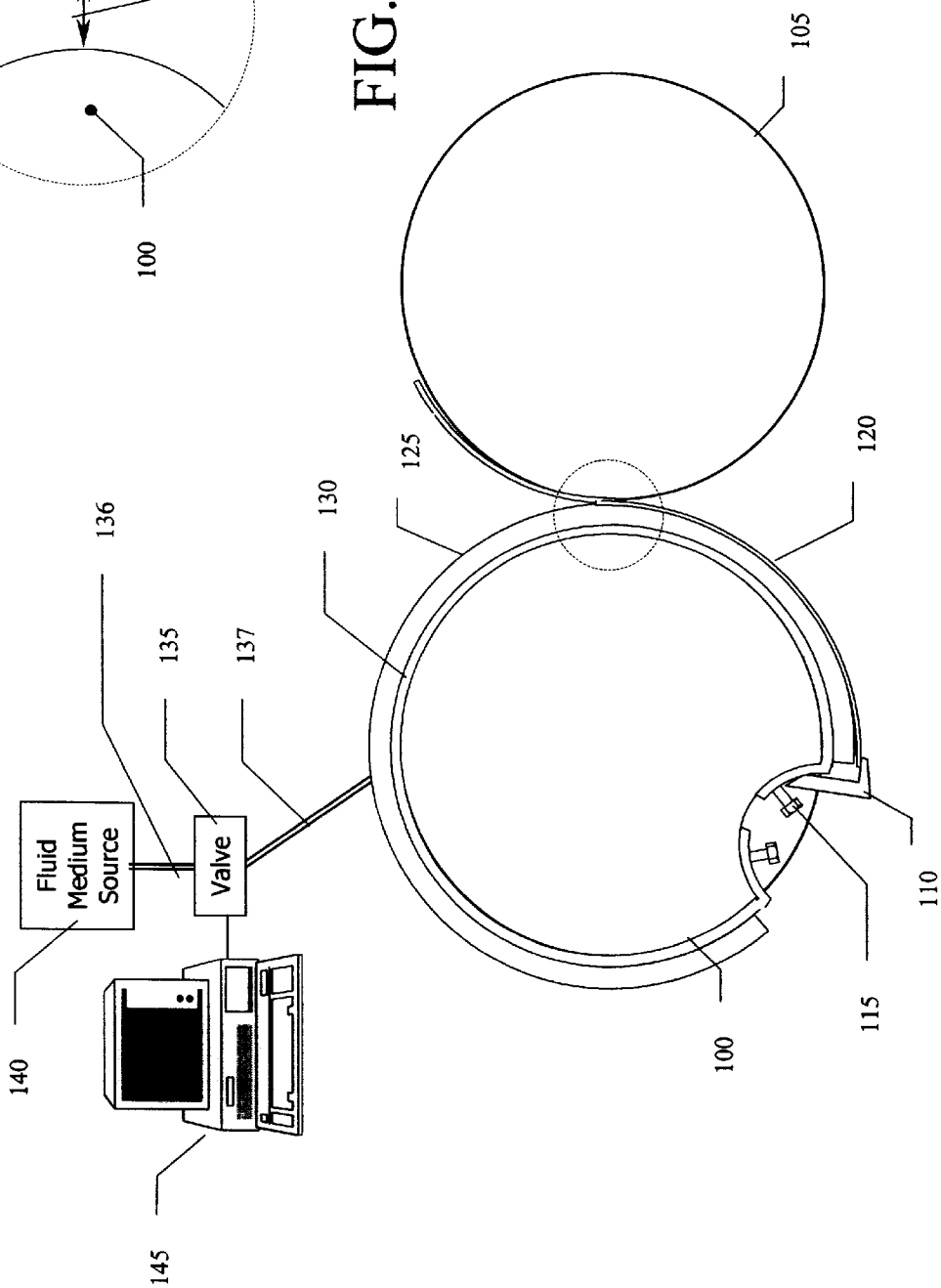
FIG. 1*a* is a cross-sectional view depicting a general overview of a printing system with a matte arranged on a transfer cylinder in accordance with one embodiment.

Certain preferred embodiments of the present invention will now be described in detail with reference to the drawings. FIG. 1*a* generally depicts an overall sheet-fed printing press system with a matte 130 arranged on transfer cylinder 100. Sheet-fed printing presses generally include a transfer cylinder 100 and an impression cylinder 105. The sheet-fed printing press is modified by mounting a matte 130 onto the outer surface of the transfer cylinder 100 wherein the matte 130 includes at least one inflatable pocket 125. This inflatable pocket 125 may take various shapes and sizes; size being limited only by the dimensions of the matte 130 itself. Possible shapes include but are not limited to a circle, square, rectangle, rectangle with rounded edges, ellipse, etc.

It is noted that although the matte 130 is shown arranged on a transfer cylinder 100, and although the majority of the discussion here refers to the transfer cylinder 100, the matte 130 can generally be arranged on any cylinder in a sheet-fed printing press which could derive the benefits and advantages offered by the matte 130. Additionally, although the matte 130 is shown with inflatable pockets 125, it is to be understood that solid tubes, or various other solid shapes, constructed of a suitable elastic or pliable material can be used to cushion sheets of printed material as they are passed between cylinders of the sheet-fed printing press. Further, solid shapes may be used in addition to, or in conjunction with, inflatable pockets 125.

At least one valve 135 may be included in the overall system which is adapted to be in fluid communication with both a fluid medium source 140, e.g., air, on its input side 136 and the inflatable pockets 125 on its output side 137. The valve 135 can be sealed between the layers 210 of the benz matte 130 itself or it can be mounted to the transfer cylinder 100, as can the fluid medium source 140, in such a manner as to allow for normal operation of the transfer cylinder 100. The valve can either be manually actuated to inflate/deflate the inflatable pockets or it can be automatically actuated via a computerized control system 145 to control the quantity of fluid medium 140 inside the inflatable pockets as desired. The pockets 125 may be selectively inflated or deflated according to many possible factors including, but necessarily limited to the size of the sheet being printed, the printing press being utilized, the locations of the printed and non-printed areas on the printable material being passed through the printing press, etc. Alternatively, a valve for each inflatable pocket can be used in order to independently control each inflatable pocket. It is emphasized that the inflatable pockets may be controlled through the use of any suitable fluid medium, air being one such fluid medium.

Figure 2:
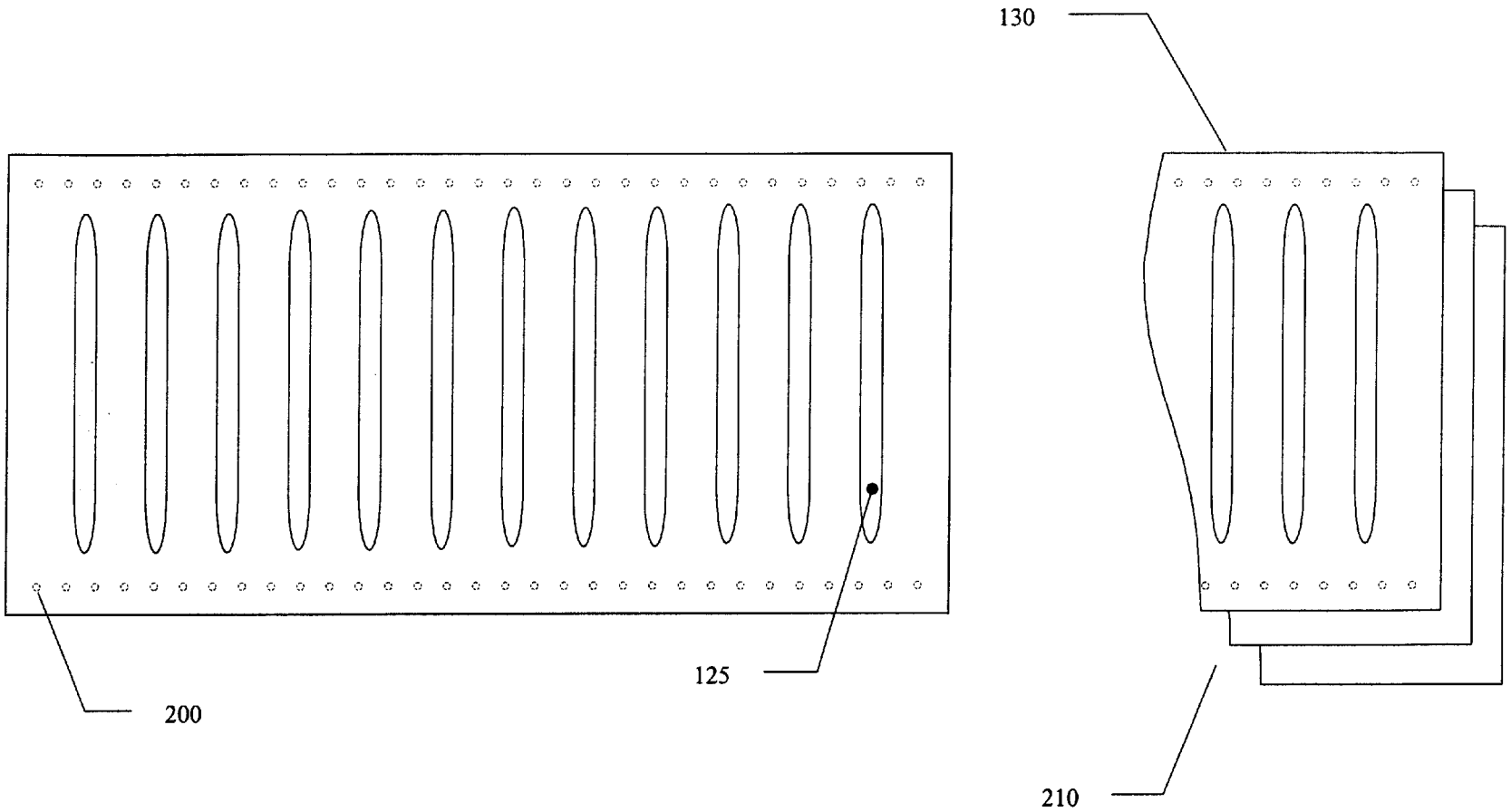
FIG. 2 is a plan view of the matte of FIG. 1*b* illustrating the general configuration.

FIG. 2 provides a more detailed view of the benz matte 130. The benz matte 130 generally includes at least two or more layers 210 horizontally disposed to one another and sealingly engaged at various locations along preferably the long axis of the matte; the long axis of the matte coincides with the long axis of the transfer cylinder. The material for the matte can be Polyvinylchloride (PVC), either clear or frosty, or any other material suitable for carrying out the invention; e.g. rubbers, plastics, polyesters, non-permeable fabrics, etc. The layers 210 of the matte are sealed in such a manner so as to form pockets 125, or unsealed areas, between the layers which are oriented along the short axis; the short axis of the matte coincides with the short axis of the transfer cylinder. At least one inflatable pocket 125 is formed between the layers 210 of the benz matte 130. However, incorporation of a plurality of pockets 125, as shown in FIG. 2, will allow a single matte to be used for multiple sheet sizes as opposed to having a matte for each corresponding sheet size.

The transfer cylinder 100, as seen in FIG. 1*a*, may include mounting studs 115 spaced along its long axis and a gripper bar 110 which extends along its long axis. The matte 130, as shown in FIG. 2, may include mounting holes 200 located along both of its long axis edges. The mounting holes 200 on the matte 130 may be arranged to receive the mounting studs 115 of the transfer cylinder 100. The mounting studs 115, therefore, can be used to quickly and easily mount the benz matte 130 by using the mounting holes 200 provided along its edges. Such an arrangement provides for a simple, cost effective and low maintenance installation. Alternatively, the matte 130 may be mounted onto the transfer cylinder through adhesively bonding the matte 130 to the surface of the transfer cylinder 100 or by securing the matte 130 to the cylinder by using VELCRO hook and loop fasteners (not shown).

Figure 3A:
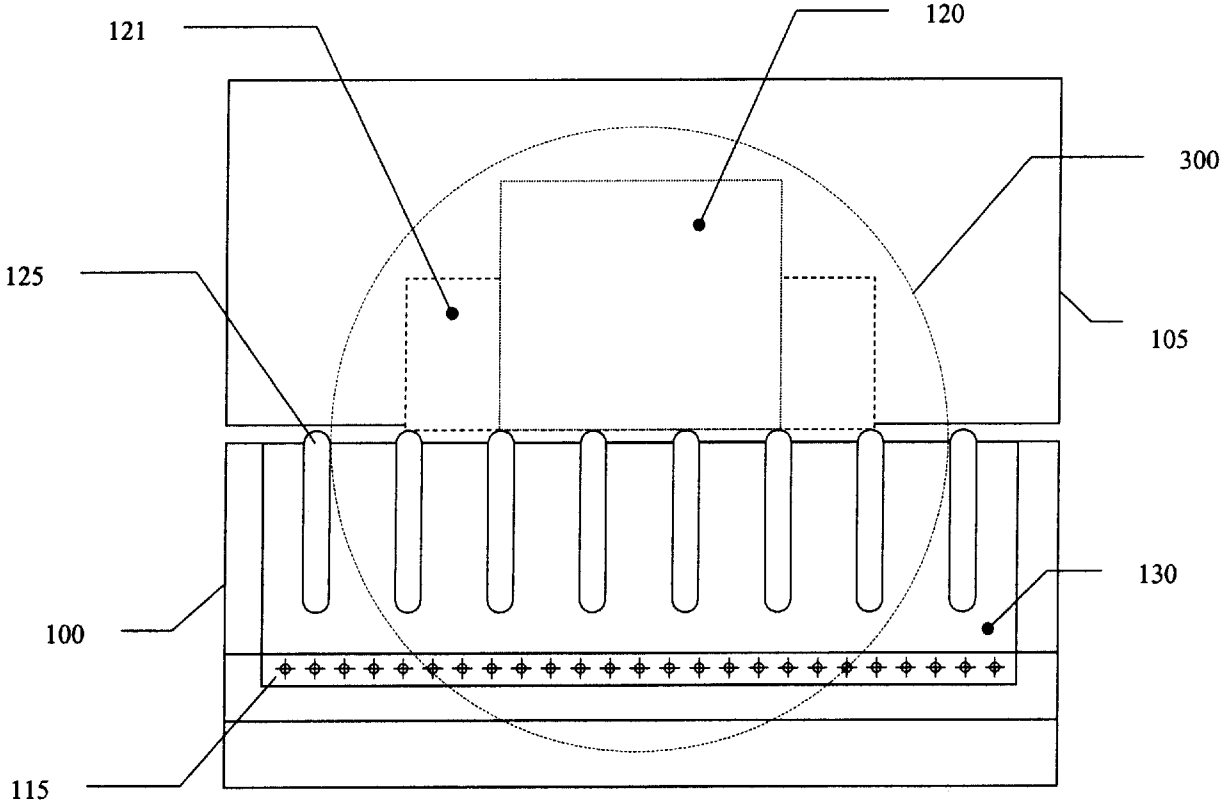
FIG. 3*a* is a plan view of the system of FIG. 1*b* in operation depicting two different sheet sizes.
Figure 3C:
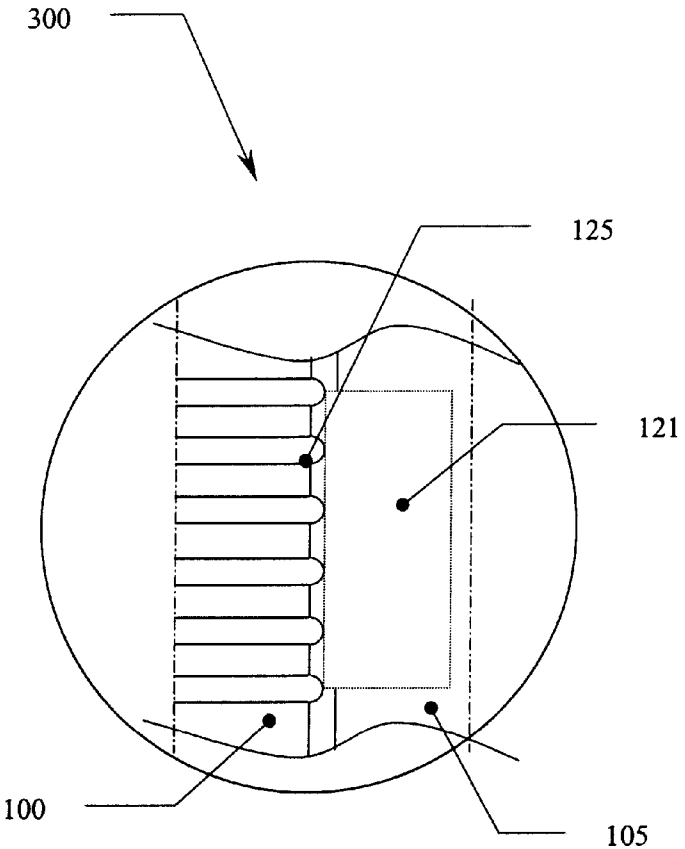
FIG. 3*c* is similar to FIG. 3*b* except that a different sheet size is depicted with corresponding pockets inflated.
Figure 3B:
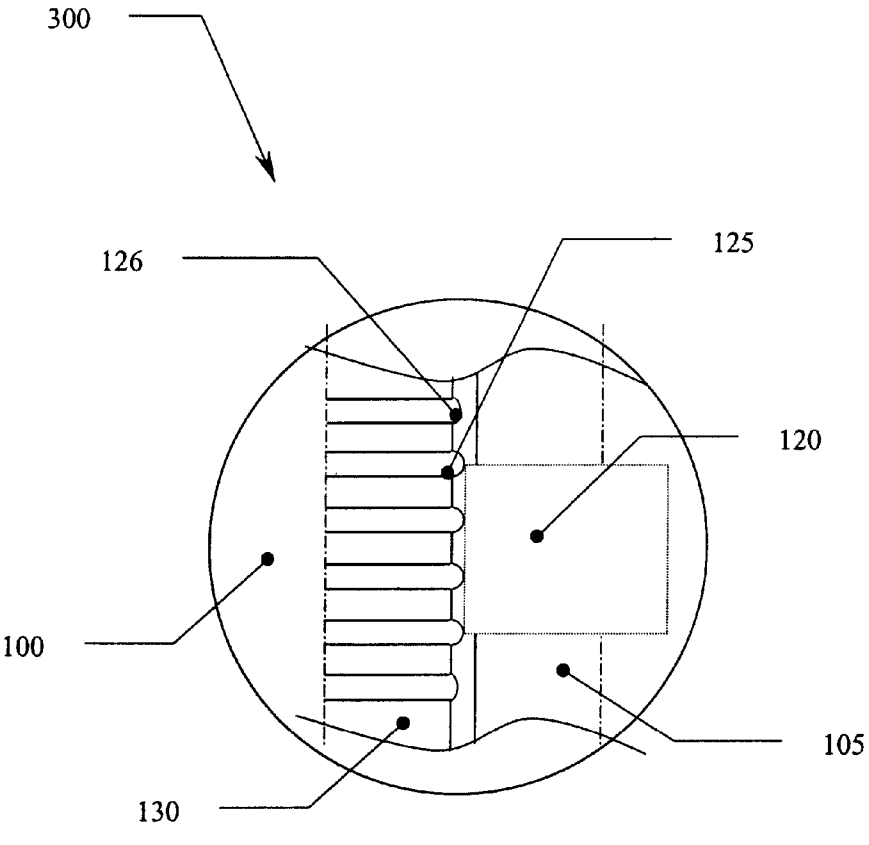
FIG. 3*b* is a detailed view of that portion of FIG. 3*a* indicated by the dashed circle depicting operation of the system with one sheet size and the corresponding pockets inflated.

FIGS. 3*a*, 3*b*, and 3*c* show multiple inflatable pockets 125 arranged so that various sizes of sheets 120, 121 can be utilized. The locations of the pockets 125 could correspond to the numerous standard sizes of sheet material (e.g., letter, legal, A4, etc.) as well as customized sheet sizes utilized in sheet-fed printing presses. Alternatively, the pockets 125 may be located at incremental positions along the long axis of the matte 130; when the matte is mounted on the transfer cylinder, the matte's short axis would correspond to the circumference of the transfer cylinder.

The appropriate pockets 125 would either be inflated or deflated depending upon the size of the sheet material 120, 121 being passed through the printing press. For example, in FIG. 3*b* it is shown that the four central pockets 125 are inflated and all the remaining pockets are deflated. This spacing of inflated pockets coincides with the size of the sheet 120 being passed through the nip 150. In other words, the pockets 125 coincide with the size of the sheet 120 thereby cushioning and supporting the entire sheet as it passes through the nip 150. This cushioning prevents the end of the sheet from "slapping out" when the press is run at high speeds.

Similarly, FIG. 3*c* illustrates a different size sheet 121 being passed through the nip 150. Accordingly, the six central inflatable pockets 125 are inflated. Again, the sheet 121 is cushioned and slapping-out at high press speeds is reduced or eliminated. The number and spacing of inflatable pockets 125 found on the matte 130 can be varied according to the needs of the user as determined by the range of sheet sizes or other characteristics of the sheets, such as weight. It is important to note that the thickness of the matte 130 and the amount of inflation of the inflatable pockets may vary depending upon the particular application and the particular printing press being used (nip size will vary depending upon the particular printing press.

Figure 4A:
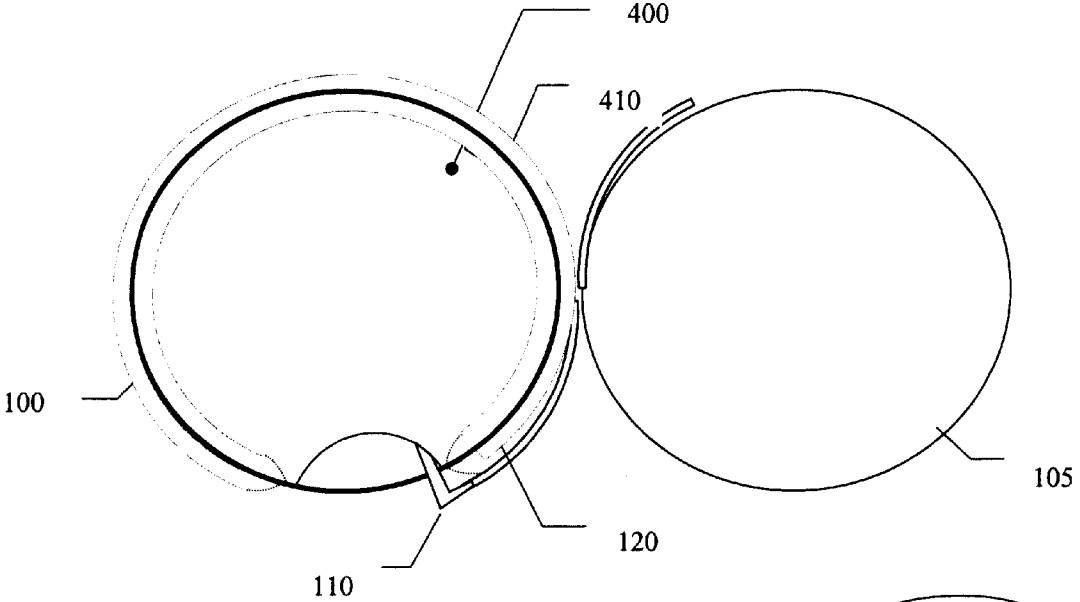
FIG. 4*a* is a cross-sectional view of an alternative embodiment wherein inflatable tubes are arranged directly onto the transfer cylinder via grooves in the outer surface of the transfer cylinder.

FIG. 4*a* illustrates an alternative embodiment in which grooves 400 are placed in the outer surface of the transfer cylinder 100. Individual inflatable tubes 410 are then installed into the grooves 400 in the outer surface of the transfer cylinder 100. The individual tubes 410 may constructed in a manner similar to the matte 130 described above. Operation of the transfer cylinder 100 having the individual tubes 410 installed directly into the grooves 400 in the outer surface of the transfer cylinder 100 is essentially the same as operation of the transfer cylinder 100 using the matte 130, described above. The number and spacing of grooves 400 and individual inflatable tubes 410 can be varied according to the needs of the user as determined by the range of sheet sizes or other characteristics of the sheets, such as weight.

Figure 4B:
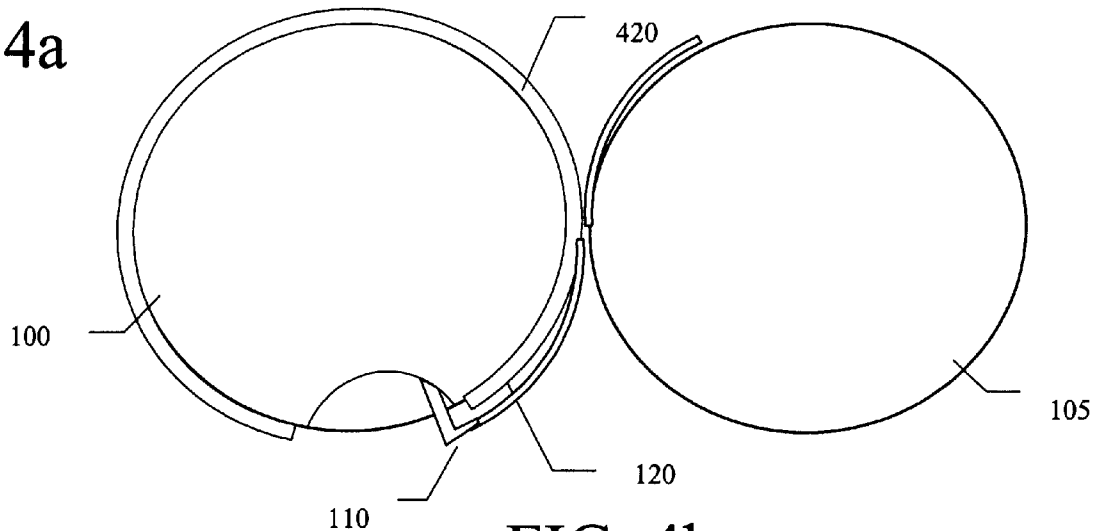
FIG. 4*b* is a cross-sectional view of another alternative embodiment wherein the inflatable tubes are adapted to be arranged directly onto the existing outer surface of the transfer cylinder without the need for grooves.

FIG. 4*b* illustrates another alternative embodiment where the inflatable tubes 420 are arranged onto the surface of the transfer cylinder 100 either by adhesively bonding (tape or glue) them to the surface or through use of an appropriate mechanical fastening device, such as fasteners, VELCRO hook and loop fasteners, hooks, etc.

Referring to FIGS. 5*a*, 5*b*, 6 and 7, another embodiment is illustrated wherein the matte 130 of FIG. 2 is omitted. Similar to the embodiment found in FIG. 4*a*, grooves 520 having at least a first edge 530 and a second edge 531 are provided in the outer surface of the transfer cylinder 100. However, instead of employing individual inflatable tubes 410, a pliable membrane 500 is arranged on the outer surface of the transfer cylinder 100 by mounting the edges of the pliable membrane 500 to mounting studs 115 on the transfer cylinder 100 through use of the mounting holes 510. The pliable membrane 500 is then sealed to the outer surface of the transfer cylinder 100 in a manner which results in the grooves 520 and the pliable membrane 500 forming sealed cavities 610.

A single valve 135, or one valve 135 for each groove 520, can be accommodated within the groove 520 and placed in fluid communication with a fluid medium source 140 to control fluid flow into and out of the sealed cavities 610. The sealed cavities 610 can then be inflated 710 or deflated 711 with a fluid medium 140 such that the portion of the pliable membrane 500 which is located above the groove 520 in the transfer cylinder 100, i.e., the portion forming the sealed cavity 610, is deflected in a radially outward direction (indicated by the dashed lines). It should be noted that the portion of the pliable membrane 500 which is located above the groove 520 could also be mechanically actuated via movable segments of the outer surface of the transfer cylinder 100; i.e., a mechanical gearing arrangement could be employed so as to actuate the movable segments and cause a deflection of the pliable membrane in a radially outward direction.

Figure 5A:
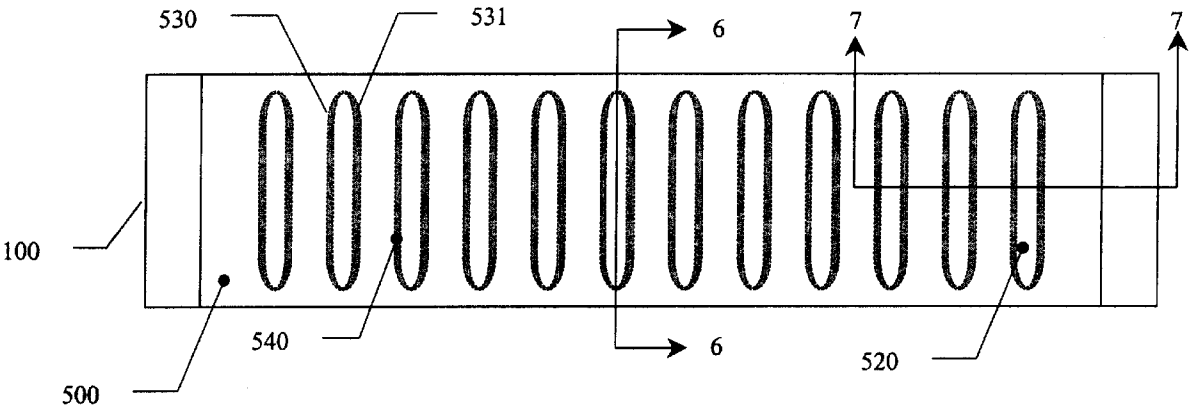
FIG. 5*a* is a front elevation view of a further alternative embodiment which has a pliable membrane mounted on a transfer cylinder, the transfer cylinder having grooves in its outer surface so that the pliable membrane and the grooves form sealed cavities.
Figure 5B:
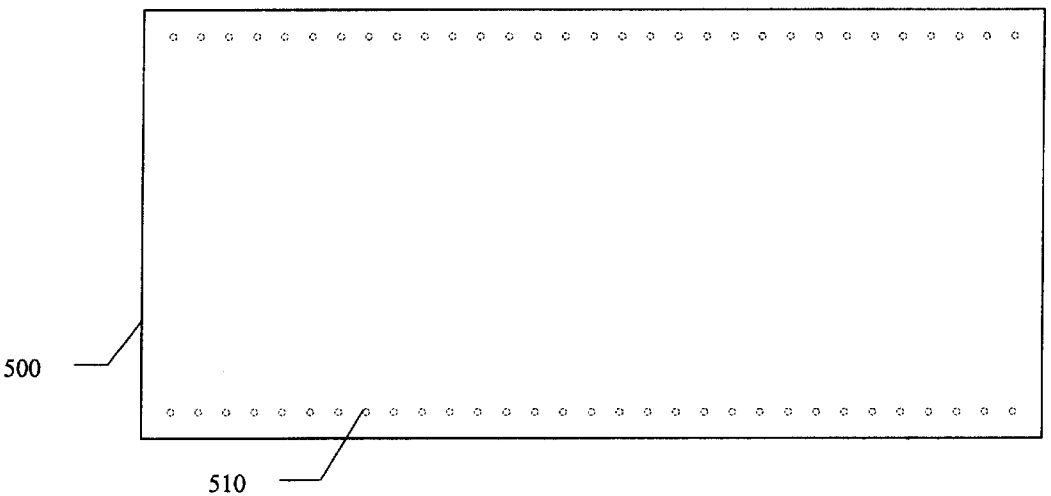
FIG. 5*b* is a plan view of the pliable membrane depicted in FIG. 5*a*.
Figure 6:
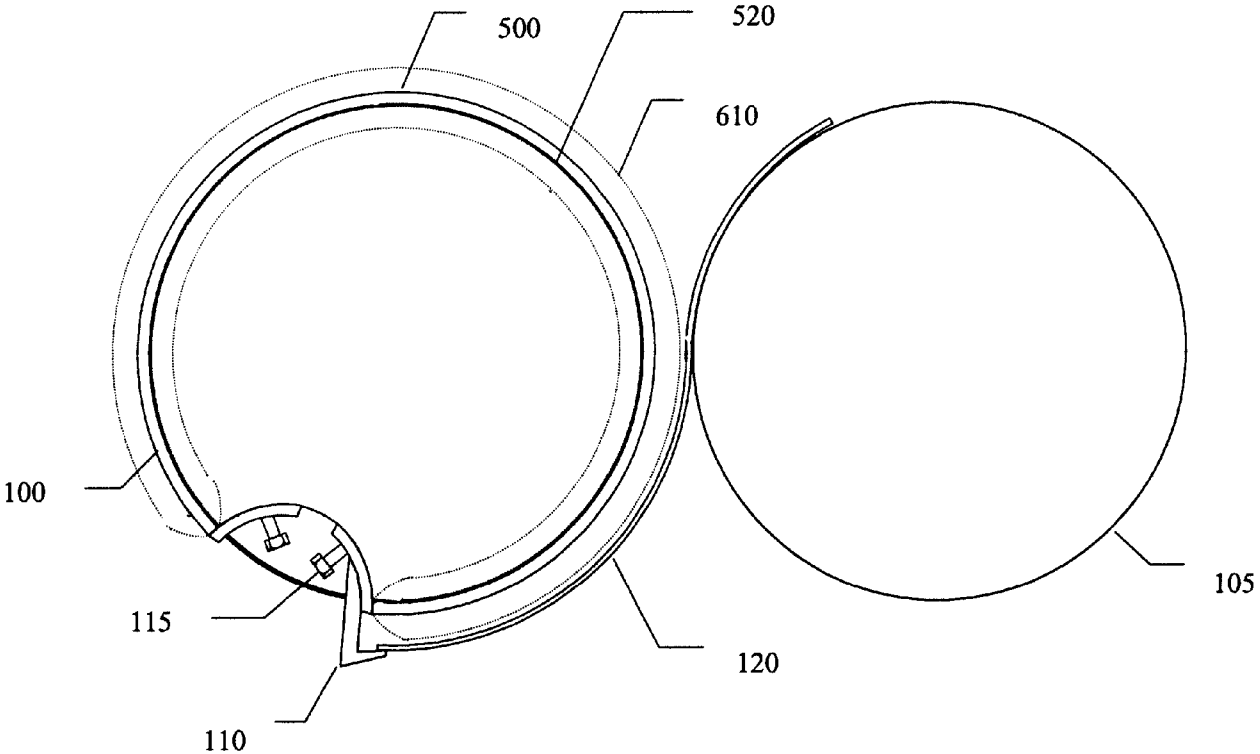
FIG. 6 is a cross-sectional view taken along the line 6—6 in FIG. 5*a* illustrating the pliable membrane arranged on the transfer cylinder.
Figure 7:
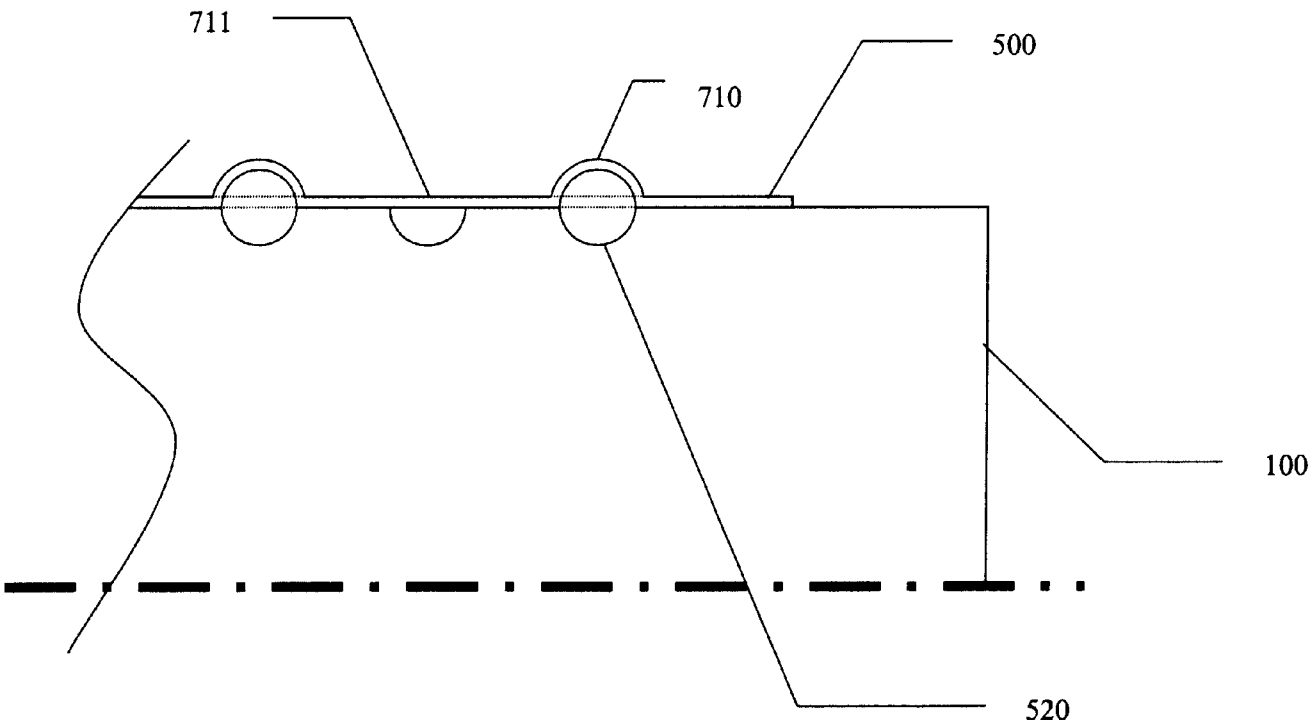
FIG. 7 is a cross-sectional view taken along the line 7—7 in FIG. 5*a* illustrating both activated and deactivated sealed cavities.
Figure 8:
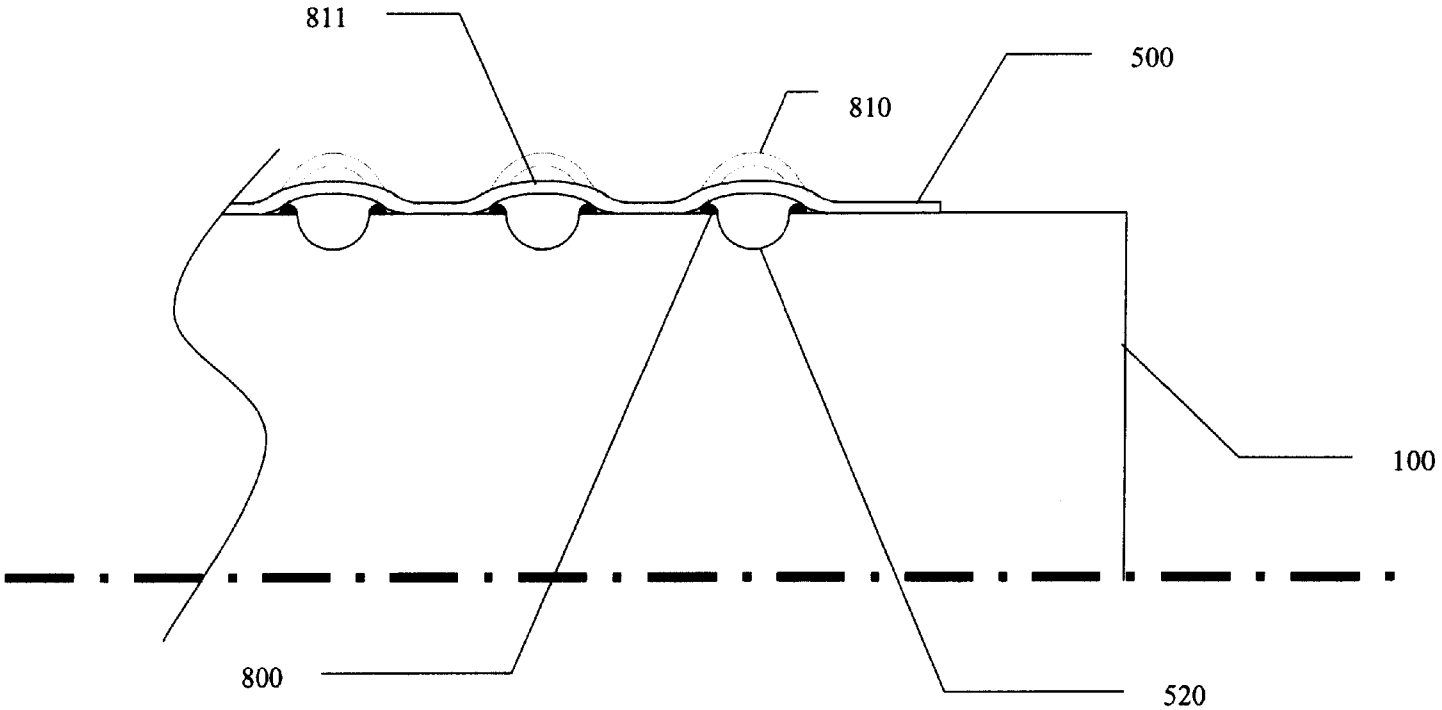
FIG. 8 is a cross-sectional view taken along the line 7—7 in FIG. 5*a* illustrating an alternative sealing means for the embodiment of FIG. 5*a;*

Various means for sealing the pliable membrane 500 to the outer surface of the transfer cylinder 100 may be employed. For example, the outer periphery 530, 531 of each groove 520 may be sealingly attached to the pliable membrane 500 so that a sealed cavity 610 is thus formed. FIG. 5*a* illustrates this outer periphery sealing arrangement by the shaded area 540 around each groove 520. It should be noted that sealing may be accomplished through either use of an adhesive (tape or glue) or through use of mechanical means, such as the O-ring 800 depicted in FIG. 8. Also, the location of the sealed area 540 is not limited by that area depicted in FIG. 5*a* nor is the shape of the sealed area necessarily limited to that of the groove 520. On the contrary, the location of the sealed area 540 may be at any point ranging from the edges 530, 531 of the groove to a point half the distance to the next adjacent groove 520. Alternatively, the entire pliable membrane 500 may be sealingly attached to the outer surface of the transfer cylinder 100.

A method of fabricating the matte 130 may use any means suitable for sealing the particular material chosen to comprise the layers 210 of the matte 130. The sealing means would seal the layers at a plurality of locations spaced preferably along the long axis of the matte 130 to form inflatable pockets 125. For example a radio frequency (RF) sealing method may be employed for materials which respond to such a method or a simple hot press. Additionally, use of adhesive (tape or glue) or chemical grafting may be utilized in fabricating the matte 130. It should also be noted that the pockets formed using the sealing method may be formed such that they are presently, and will remain, in the inflated state.

In addition, while it is preferable to orient the pockets, tubes and grooves along the long axis of the cylinder 130, the inflatable pockets 125, inflatable tubes 420 and grooves 400 may be oriented perpendicular to the orientation depicted (not shown). Therefore, the inflatable pockets 125, inflatable tubes 420 and grooves 400 may also be oriented such that they extend along the length of the cylinder 100 and are spaced at various positions along the circumference of the cylinder 100.

Figure 9:
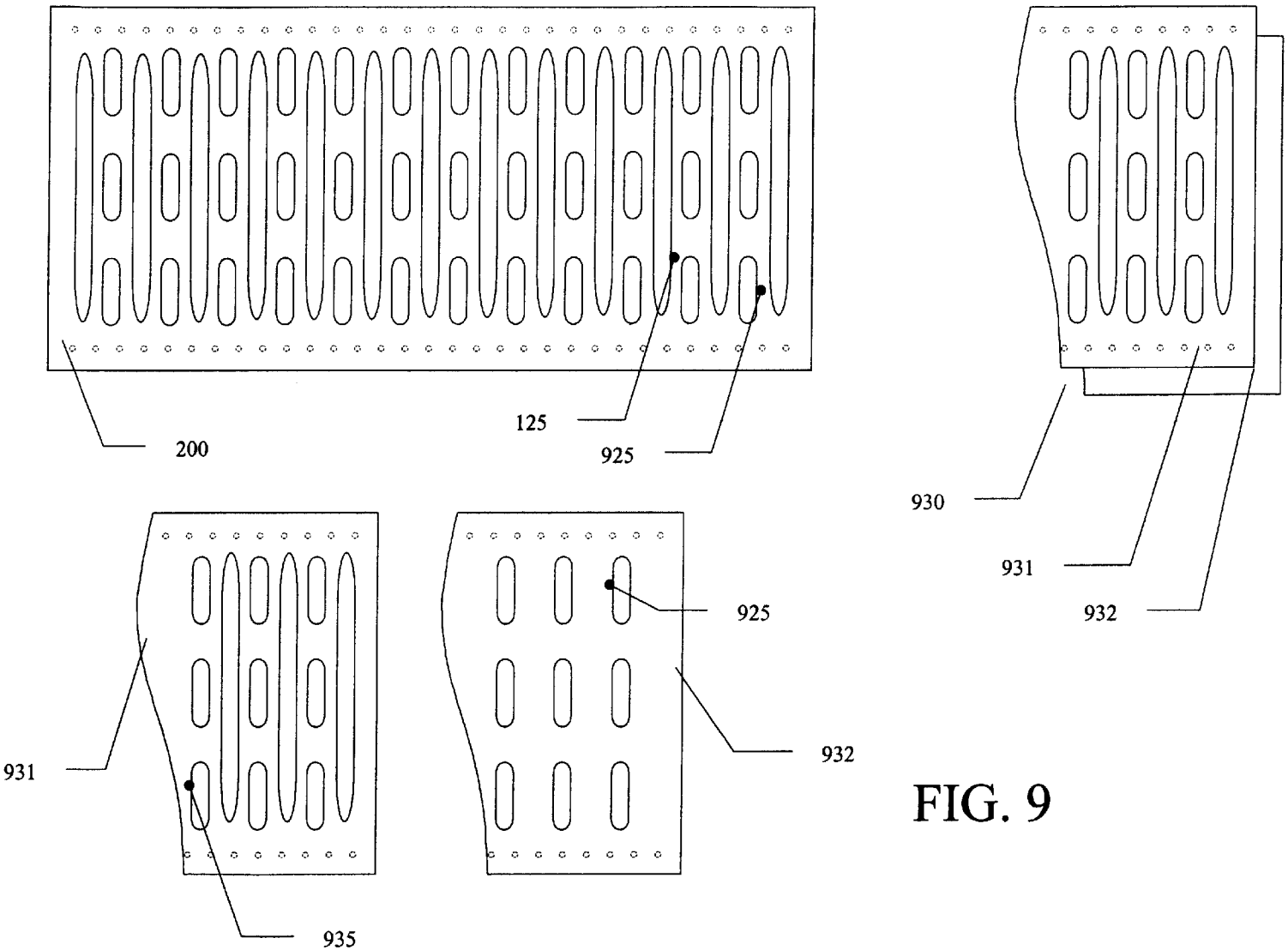
FIG. 9 is a plan view depicting a compound matte which uses more than one matte arranged one atop the other.

FIG. 9 illustrates an alternative embodiment in which more than one matte 130 is utilized, resulting in a compound matte 930 which would be arranged on a cylinder of the sheet-fed printing press. The compound matte 930 illustrated in FIG. 9 generally includes two mattes 931, 932, each capable of being independently operated or controlled. The two mattes 931, 932 are arranged one atop the other in a coplanar manner. The lower matte 932 may be configured as in the matte 130 shown in FIG. 2. The upper matte 931 may also be generally configured as in the matte 130 shown in FIG. 2 with the exception that openings are provided in the matte 931 which pass through the layers comprising the individual matte 931. These openings are positioned in the surface of the matte 931 and correspond generally to the shape and location of the inflatable pockets included in the lower matte 932.

Additionally, although the compound matte 930 is shown with inflatable pockets 125, 925, it is to be understood that solid tubes, or various other solid shapes, constructed of a suitable elastic or pliable material can be used to cushion sheets of printed material as they are passed between cylinders of the sheet-fed printing press. Further, solid shapes may be used in addition to, or in conjunction with, inflatable pockets 125, 925, and on the same or different individual mattes 931, 932. For example, individual matte 931 may contain only solid shapes and individual matte 932 may contain only inflatable pockets, or vice versa. Also, individual mattes 931, 932 may each simultaneously contain both solid shapes and inflatable pockets.

Figures 10, 10B:
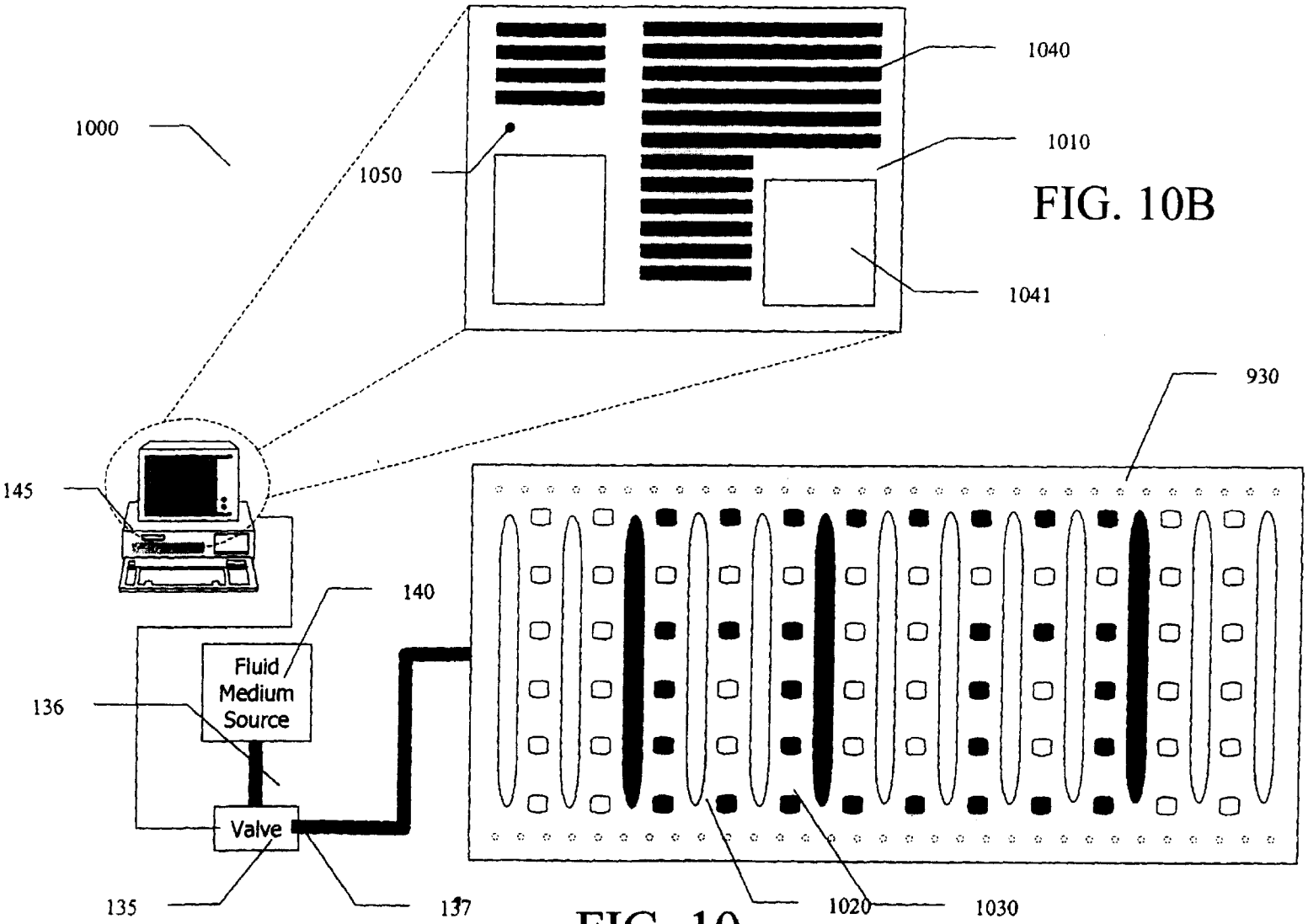
FIGS. 10 and FIG. 10B are a plan view depicting a general overview of a printing system utilizing the compound matte of FIG. 9.

FIGS. 10 and 10B are a general overview of a system 1000 employing the compound matte 930 shown in FIG. 9. The system 1000 can be used with a printed sheet of material 1010 in order to more precisely transfer the non-print image areas 1050 of the printed sheet of material 1010 to the compound matte 930; i.e., to inflate the appropriate inflatable pockets 1020, 1030 corresponding to the non-print areas 1050 of the printed sheet of material 1010. This is generally accomplished through use of the computerized control system 145 and a suitable imaging/plotting software package.

Figure 11:
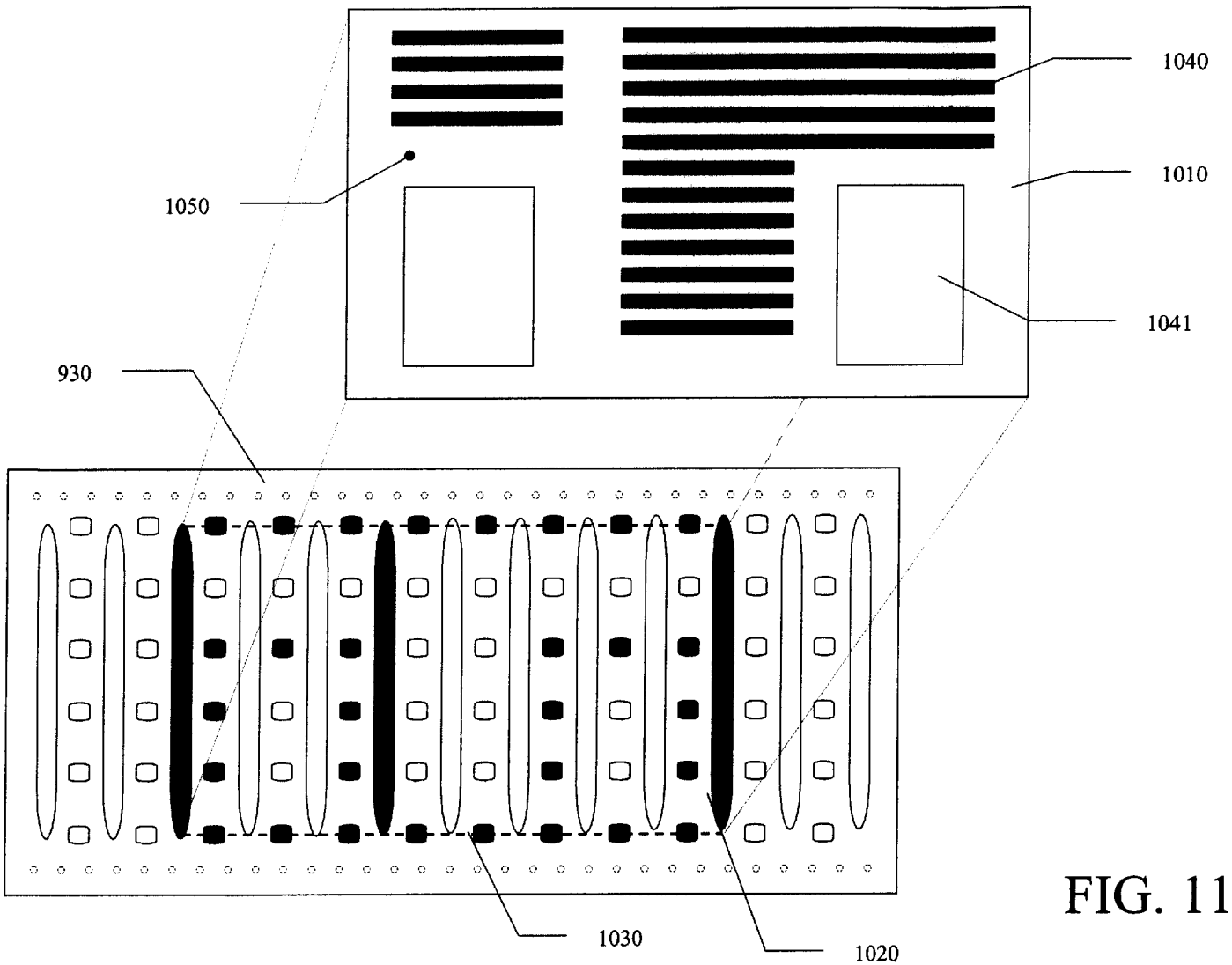
FIG. 11 is a plan view of the compound matte of FIG. 10 with the inflatable pockets of each individual matte corresponding to the non-print areas of the printed sheet of material inflated.

An image to be printed, which can consist of text, pictures, drawings, etc. or any combination thereof, can generally be stored in a computerized control system 145 as an electronic file in a format that is compatible with the imaging/plotting software selected; e.g., TIFF, JPEG, BMP, etc. The imaging/plotting software is used to determine the locations of the printed 1040, 1041 and non-printed areas 1050 of the image, as shown in FIG. 10B. The computerized control system 145 then uses this print/non-print data to determine which inflatable pockets 1020, 1030 of the compound matte 930 must be inflated; i.e., to inflate those inflatable pockets 1020, 1030 corresponding to the non-print areas of the printed sheet of material 1010. Therefore, as can be seen in FIG. 11, depending on the print/non-print areas, the printed sheet of material 1010 will be cushioned in the appropriate locations as it is passed between two cylinders or as it is transferred from one print station to another. Such an implementation not only reduces slap-out, but also reduces smearing of wet images, dot distortion and print length difference between one print station and another during transfer within a print output device.

It should be clear that the compound matte 930 shown in FIGS. 9–11 can be configured for varying degrees of resolution; i.e., an appropriate number, size and shape of inflatable pockets as well as an appropriate number of individual mattes 931, 932 comprising the compound matte 930 can be provided depending on the resolution and precision required for a particular application/printing press.

Furthermore, since numerous modifications and variations will readily occur to those skilled in the art, it is not desired that the present invention be limited to the exact construction and operation illustrated and described herein, and accordingly, all suitable modifications and equivalents which may be resorted to are intended to fall within the scope of the claims.

What is claimed is:

1. An apparatus for facilitating handling of sheets in a sheet-fed printing press as they are passed between a first cylinder and a second cylinder, comprising:

a matte having at least one inflatable pocket for cushioning sheets of printed material as they are passed through the first and second cylinders wherein the matte is mounted to the first cylinder such that the matte can conform to any shape of the first cylinder.

2. The apparatus according to claim 1, further comprising at least one valve in fluid communication with the inflatable pocket for controlling a quantity of fluid therein.

3. The apparatus according to claim 2, wherein the at least one inflatable pocket includes a plurality of inflatable pockets.

4. The apparatus according to claim 3, wherein the valve selectively inflates or deflates at least one of the plurality of inflatable pockets.

5. The apparatus according to claim 4, wherein the matte comprises a plurality of layers.

6. The apparatus according to claim 5, wherein at least one of the plurality of layers is formed from a pliable material.

7. The apparatus according to claim 6, wherein the pliable material is selected from the group consisting of polyvinylchloride, plastic, rubber and non-permeable fabric.

8. The apparatus according to claim 6, the matte having a long axis and a short axis, the long axis to be aligned with the first cylinder's length and the short axis to be aligned along the first cylinder's circumference, wherein the at least one of the plurality of layers is sealingly engaged along the short axis at a plurality of locations spaced along the long axis.

9. The apparatus according to claim 8, wherein the plurality of locations are arranged to coincide with various sizes of the sheets of printed material.

10. The apparatus according to claim 2, wherein the at least one valve includes a plurality of independently operable valves, one for each of the plurality of inflatable pockets.

11. The apparatus according to claim 2, further comprising a fluid medium source in fluid communication with the at least one valve.

12. The apparatus according to claim 1, wherein the matte further includes at least one inflatable pocket that receives fluid medium independent of contact with the first cylinder.

13. The apparatus according to claim 1, wherein the matte has a long axis having holes for mounting the matte on the first cylinder, the long axis to be aligned along the first cylinder's length.

14. The apparatus according to claim 13, wherein the matte is mounted to the first cylinder.

15. The apparatus according to claim 12, wherein the matte is adhesively mounted to the first cylinder.

16. The apparatus according to claim 12, wherein the matte has a long axis having Velcro hook and loop fasteners for mounting the matte on the first cylinder, the long axis to be aligned along the first cylinder's length.

17. The apparatus according to claim 16, wherein the matte is mounted to the first cylinder.

18. An apparatus for facilitating handling of sheets in a sheet-fed printing press as they are passed between a first cylinder and a second cylinder, comprising:

inflatable cushion means for cushioning sheets of printed material as they are passed between the first and second cylinders, wherein the inflatable cushion means is mounted to the first cylinder such that the inflatable cushion means can conform to any shape of the first cylinder.

19. The apparatus according to claim 18, further comprising flow-control means in fluid communication with the cushioning means for controlling a quantity of fluid in the inflatable cushion means.

20. The apparatus according to claim 19, further comprising a fluid medium source means for providing the fluid to the flow-control means.

21. The apparatus according to claim 20, wherein the flow control means selectively controls the quantity of fluid in the inflatable cushion means.

22. An apparatus for facilitating handling of sheets in a sheet-fed printing press as the sheets are passed between a first cylinder and a second cylinder, the apparatus being mountable on the first cylinder and comprising:

at least one inflatable tube for cushioning sheets of printed material as the sheets are passed between the first and second cylinders; and at least one valve in communication with the tube such that the valve receives a fluid medium independent of contact with the first cylinder.

23. The apparatus according to claim 22, wherein the valve is in fluid communication with the inflatable tube for controlling a quantity of fluid in the inflatable tube.

24. The apparatus according to claim 23, wherein the at least one inflatable tube includes a plurality of inflatable tubes.

25. The apparatus according to claim 24, wherein the at least one valve selectively controls the quantity of fluid in at least one of the plurality of inflatable tubes.

26. The apparatus according to claim 22, wherein the first cylinder includes an outer surface adapted to receive the at least one inflatable tube.

27. The apparatus according to claim 24, wherein the first cylinder includes an outer surface adapted to receive the plurality of inflatable tubes at a plurality of locations spaced along a long axis of the first cylinder for receiving various sheet sizes.

28. The apparatus according to claim 24, wherein the at least one valve includes a plurality of independently operable valves for selectively controlling the quantity of fluid in the plurality of inflatable tubes.

29. The apparatus according to claim 28, wherein the plurality of independently operable valves includes one valve for each of the plurality of inflatable tubes.

30. The apparatus according to claim 24, further comprising a fluid medium source in fluid communication with the at least one valve.

31. An apparatus for facilitating handling of sheets in a sheet-fed printing press as they are passed between a first cylinder and a second cylinder, the apparatus comprising:

an outer surface of the first cylinder having a plurality of grooves extending substantially along a circumference of the first cylinder, the plurality of grooves having at least a first edge and a second edge in the outer surface of the first cylinder defining outer peripheries of the plurality of grooves, the first and second edges being spaced along a long axis of the first cylinder;

a pliable membrane arranged on the first cylinder and sealingly attached to the outer surface of the first cylinder at least at the outer peripheries of the plurality of grooves, wherein a plurality of sealed cavities for receiving a quantity of fluid are formed by the plurality of grooves and by portions of the pliable membrane which sealingly enclose the plurality of grooves for cushioning sheets of printed material as they are passed between the first and second cylinders.

32. The apparatus according to claim 31, further comprising at least one valve in fluid communication with the sealed cavities for controlling the quantity of fluid in at least one of the plurality of sealed cavities to cause a deflection of at least one of the portions of the pliable membrane forming the plurality of sealed cavities.

33. The apparatus according to claim 32, wherein the at least one valve selectively adjusts a deflection of at least one of the portions of the pliable membrane forming the plurality of sealed cavities.

34. The apparatus according to claim 32, wherein the at least one valve includes a plurality of independently operable valves for selectively controlling the quantity of fluid in the plurality of sealed cavities to cause a deflection in the portions of the pliable membrane forming the plurality of sealed cavities.

35. The apparatus according to claim 34, wherein the plurality of independently operable valves includes one valve for each of the plurality of sealed cavities.

36. The apparatus according to claim 31, wherein the plurality of grooves are spaced at a plurality of locations on the outer surface of the first cylinder spaced along the long axis of the first cylinder to receive various sizes of the sheets of printed material.

37. A method of forming an apparatus for facilitating handling of sheets in a sheet-fed printing press as they are passed between a first cylinder and a second cylinder, the method comprising:

selecting a pliable material for at least one layer of a matte;

selecting a suitable material for at least a second layer of the matte;

applying a sealing means to the pliable material at least at two locations spaced along a long axis of the matte whereby at least one inflatable pocket is formed.

38. The method according to claim 37, further comprising adapting the matte to allow the at least one inflatable pocket to be in fluid communication with at least one valve.

39. The method according to claim 38, further comprising arranging the valve between the layers of the matte.

40. A method for facilitating handling of sheets in a sheet-fed printing press as they are passed between a first cylinder and a second cylinder, the first cylinder having a matte with at least one inflatable pocket arranged thereon, the method comprising:

controlling a quantity of fluid in the at least one inflatable pocket for cushioning sheets of printed material as they are passed through the first and second cylinders; and receiving the fluid independent of contact with the first cylinder.

41. The method according to claim 40, further comprising operating a valve to control the quantity of fluid in the at least one inflatable pocket.

42. The method according to claim 40, further comprising selecting a printed sheet size.

43. The method according to claim 42, further comprising operating a valve to control a quantity of fluid in the at least one inflatable pocket to receive the printed sheet size selected.

44. An apparatus for facilitating handling of sheets in a sheet-fed printing press as they are passed between a first cylinder and a second cylinder, the apparatus being mountable on the first cylinder and comprising:

a compound matte including at least two mattes, a first matte and a second matte arranged on the first matte;

the first and second mattes having at least one inflatable pocket each for cushioning sheets of printed material as they are passed through the first and second cylinders; and the second matte having at least one opening adapted to allow the at least one inflatable pocket of the first matte to pass therethrough when the at least one inflatable pocket of the first matte is inflated.

45. The apparatus according to claim 44, further comprising at least one valve in fluid communication with the at least one inflatable pocket of each matte for controlling a quantity of fluid therein.

46. The apparatus according to claim 45, wherein the at least one inflatable pocket of the first or second matte includes a plurality of inflatable pockets.

47. The apparatus according to claim 46, wherein the valve selectively inflates or deflates at least one of the inflatable pockets of the first or second matte.

48. The apparatus according to claim 47, further comprising a control unit for automatically controlling the quantity of fluid in the inflatable pockets of the first and second mattes.

49. The apparatus according to claim 48, wherein the control unit receives information about the printable sheet of material, processes the information and determines which inflatable pockets to inflate on the first and second mattes.

50. The apparatus according to claim 49, wherein the control unit actuates the valve to inflate the appropriate inflatable pockets on the first and second mattes according to the processed information.

51. The apparatus according to claim 50, wherein the at least one valve includes at least one independently operable valve for each of the mattes.

52. The apparatus according to claim 51, wherein the at least one independently operable valve for each of the mattes includes at least one independently operable valve for each of the inflatable pockets.

53. A method for facilitating handling of sheets in a sheet-fed printing press as they are passed between a first cylinder and a second cylinder, the first cylinder having a compound matte arranged thereon, the compound matte comprising at least two mattes, each matte having at least one inflatable pocket, the method comprising:

receiving data associated with an image to be printed; and controlling a quantity of fluid in the inflatable pockets of the compound matte according to the data.

54. The method according to claim 53, further comprising:

receiving an electronic image file of the image to be printed;

processing the electronic image file to identify non-print areas;

controlling the quantity of fluid in the inflatable pockets of the compound matte corresponding to the non-print areas.

55. The method according to claim 54, further comprising:

operating a valve to control the quantity of fluid in the inflatable pockets of the compound matte.

* * * * *